US009099210B2

(12) United States Patent
Aizawa et al.

(10) Patent No.: US 9,099,210 B2
(45) Date of Patent: Aug. 4, 2015

(54) RADIOACTIVE SLUDGE TRANSFER APPARATUS

(75) Inventors: Masahiro Aizawa, Chiyoda-ku (JP); Osamu Ogata, Chiyoda-ku (JP)

(73) Assignee: TAIHEI DENGYO KAISHA, LTD., Tokyo (JP)

( * ) Notice: Subject to any disclaimer, the term of this patent is extended or adjusted under 35 U.S.C. 154(b) by 48 days.

(21) Appl. No.: 13/976,522

(22) PCT Filed: Aug. 9, 2011

(86) PCT No.: PCT/JP2011/068122

§ 371 (c)(1),
(2), (4) Date: Jun. 27, 2013

(87) PCT Pub. No.: WO2012/096021

PCT Pub. Date: Jul. 19, 2012

(65) Prior Publication Data

US 2013/0291972 A1 Nov. 7, 2013

(30) Foreign Application Priority Data

Jan. 11, 2011 (JP) ..... 2011-002912

(51) Int. Cl.
*B01F 5/02* (2006.01)
*G21F 9/00* (2006.01)
(Continued)

(52) U.S. Cl.
CPC ..... *G21F 9/008* (2013.01); *B01F 5/0206* (2013.01); *B01F 5/0243* (2013.01); *F17D 1/00* (2013.01); *F17D 1/14* (2013.01); *G21F 9/22* (2013.01); *G21F 9/28* (2013.01); *G21F 9/30* (2013.01); *Y10T 137/86035* (2015.04)

(58) Field of Classification Search
CPC ..... B01F 5/106; B01F 5/10; B01F 5/02; B01F 5/0206; B01F 5/0218; B01F 5/0225; B01F 5/0243; B01F 5/025; B01F 5/108; F17D 1/00; G21F 9/22; G21F 9/30
USPC ..... 366/136, 137, 173.1, 173.2, 181.6; 137/3, 88, 91
See application file for complete search history.

(56) References Cited

U.S. PATENT DOCUMENTS 5,078,799 A * 1/1992 Matter et al. ..... 134/22.18
5,863,119 A * 1/1999 Yergovich et al. ..... 366/137
(Continued)

FOREIGN PATENT DOCUMENTS

JP 61-204029 A 9/1986
JP 2000-65980 A 3/2000
(Continued)

OTHER PUBLICATIONS

International Search Report for PCT/JP2011/068122 dated Sep. 6, 2011.

*Primary Examiner* — Charles Cooley
(74) *Attorney, Agent, or Firm* — Sughrue Mion, PLLC

(57) ABSTRACT

There is provided a radioactive sludge transfer apparatus for transferring sludge stored in a sludge storage tank with supernatant solution to a transfer tank including: a transfer apparatus body; a stifling apparatus for blasting the supernatant solution to the sludge to thereby produce sludge solution in the one tank; sludge solution transfer apparatus for transferring the sludge solution to the transfer tank; an attitude control float; a floating force control ballast tank; and control device for remotely controlling the stifling apparatus, the sludge solution transfer apparatus and the floating force control ballast tank.

4 Claims, 10 Drawing Sheets

(51) Int. Cl.

| | |
|---|---|
| ***G21F 9/22*** | (2006.01) |
| ***G21F 9/28*** | (2006.01) |
| ***G21F 9/30*** | (2006.01) |
| ***F17D 1/00*** | (2006.01) |
| ***F17D 1/14*** | (2006.01) |

(56) References Cited

U.S. PATENT DOCUMENTS

| | | | | |
|---|---|---|---|---|
| 6,217,207 | B1 * | 4/2001 | Streich et al. | 366/137 |
| 2013/0098483 | A1 * | 4/2013 | Aizawa et al. | 137/565.23 |
| 2013/0291972 | A1 * | 11/2013 | Aizawa et al. | 137/565.17 |
| 2014/0112093 | A1 * | 4/2014 | Puck | 366/182.2 |

FOREIGN PATENT DOCUMENTS

| | | | |
|---|---|---|---|
| JP | 2008-96116 | A | 4/2008 |
| JP | 4356728 | B2 | 11/2009 |

* cited by examiner

RADIOACTIVE SLUDGE TRANSFER APPARATUS

CROSS REFERENCE TO RELATED APPLICATIONS

This application is a National Stage of International Application No. PCT/JP2011/068122 filed Aug. 9, 2011, claiming priority based on Japanese Patent Application No. 2011-002912 filed Jan. 11, 2011, the contents of all of which are incorporated herein by reference in their entirety.

FIELD OF THE INVENTION

The present invention relates to a radioactive sludge transfer apparatus, and more particularly, to a radioactive sludge transfer apparatus capable of safely and surely transferring radioactive sludge contaminated by radioactive substance stored in a sludge storage tank to another tank for the sake of inspection or like of the sludge storage tank.

BACKGROUND TECHNOLOGY

A radioactive sludge contaminated by radioactive substance (called merely "sludge" hereinafter) composed of an ion exchange resin or filtration auxiliary agent and the like, which may be generated according to the operation (i.e., running) of a nuclear power plant, is stored for a certain predetermined time in a sludge storage tank together with supernatant solution for attenuating radiation, thereafter, taken out from the sludge storage tank, and then, transferred to and treated at a processing section.

Further, the supernatant solution is generated by a reason such that when the sludge is transferred to the storage tank, it is impossible to transfer the sludge on its own, so that it is necessary to make the sludge as sludge solution (liquid state) having fluidity by being mixed with water or like. When the thus formed sludge solution is transferred to the storage tank, the sludge is precipitated downward in the storage tank, and hence, the supernatant solution is generated above the precipitated sludge.

It is required for such sludge storage tank to have high reliability, and accordingly, the sludge storage tank is periodically inspected to inspect leakage or like of the supernatant, and repaired as occasion demands. In order to carry out the inspection of the sludge storage tank, it is necessary to empty the sludge storage tank, which requires for the stored sludge to be transferred or delivered into another tank. However, it is an essential requirement that such transferring working should be performed under the condition of most-reduced exposure of radiation to workers.

One example of a radioactive sludge transfer apparatus for solving the above inevitable problem is disclosed in Patent Document 1 (Japanese Patent Publication No. 4356728). Hereunder, this radioactive sludge transfer apparatus disclosed in the above publication will be mentioned as "conventional transfer system" and explained with reference to a drawing.

FIG. 11 is a schematic diagram showing a structure of the conventional transfer system.

With reference to FIG. 11, reference character T1 denotes a sludge storage tank in which sludge 31 is stored, reference character T2 denotes a transfer tank, as another tank, into which the sludge 31 stored in the sludge storage tank T1 is transferred, reference numeral 32 is supernatant solution of the sludge 31, and reference numeral 33 is an air-blowing device including an air supply source 34, an air pipe 35 and an air nozzle 36. The air-blowing device 33 injects air to the supernatant solution of the sludge 31 stored in the sludge storage tank T1 to thereby locally stir the supernatant solution 32, thus generating a sludge solution 37 having fluidity.

Reference character P1 denotes a sludge transfer pump, reference character P2 is a supernatant solution return pump disposed inside the transfer tank T2, reference numeral 38 is a sludge solution transfer path connecting the sludge transfer pump P1 and the transfer tank T2, reference numeral 39 is a supernatant solution transfer path connected to the supernatant solution return pump P2, and reference numeral 40 is a supernatant solution jetting device connecting to the supernatant solution transfer path 39. The supernatant solution jetting device 40 acts to spray or jet the supernatant solution 32, as highly pressurized water jet, from the supernatant solution transfer path 39 toward the sludge 31 stored in the sludge storage tank T1 through a supernatant solution jetting nozzle 42 mounted to a supernatant solution pipe 41.

The above-mentioned air pipe 35, the sludge solution transfer path 38, the supernatant solution transfer path 39 and the supernatant solution pipe 41 are set into the sludge storage tank T1 or the transfer tank T2 through inspection holes 43 which are shielded by radiation shielding means 44, respectively.

Further, reference numeral 45 denotes a monitoring camera set to the sludge storage tank T1 so as to monitor the condition such as sludge solution forming state or process inside the sludge storage tank T1. Reference numeral 46 is a monitoring camera set inside the transfer tank T2 so as to monitor the condition such as supernatant solution forming state or process inside the transfer tank T2. Reference numeral 47 is a control device that controls, in accordance with image information from the monitoring cameras 45 and 46, a series of sludge transferring operations by operating valves B1 to B4 mounted to the air-blowing device 33, the supernatant solution jetting device 40, the sludge solution transfer path 38 and the supernatant solution transfer path 39.

According to the conventional transfer system, the sludge 31 stored in the sludge storage tank T1 is transferred to the transfer tank T2 in a manner mentioned hereunder.

First, air is blown into the supernatant solution in the sludge storage tank T1 by means of the air-blowing device 33 to thereby locally stir the supernatant solution. According to this operation, the sludge 31 stored in the sludge storage tank T1 is crushed, and a sludge solution 37 having fluidity is thereby formed on the sludge 31.

When the sludge solution 37 is formed by the manner mentioned above, the sludge solution 37 is sucked by the sludge transfer pump P1 and then transferred to the transfer tank T2 through the sludge solution transfer path 38. The sludge solution 37 transferred into the transfer tank T2 is separated into the sludge 31 and the supernatant solution 32 according to the time elapsed.

According to the operation mentioned above, when the supernatant solution 32 is stored in the inside of the transfer tank T2, the supernatant solution 32 is sucked by the supernatant solution return pump P2 and transfer the supernatant solution 32 to the supernatant solution jetting device 40 through the supernatant solution transfer path 39. The supernatant solution jetting device 40 acts to jet or spray the supernatant solution 32 onto the sludge 31 stored in the sludge storage tank T1 through the supernatant solution jetting nozzle 42 via the supernatant solution pipe 41. Thus, the sludge 31 is crushed and the sludge solution 37 is then formed.

Thereafter, the sludge solution 37 in the sludge storage tank T1 is sucked again by the sludge transfer pump P1 and then transferred to the transfer tank T2 through the sludge transfer path 38. Then, the supernatant solution in the transfer tank T2 is jetted or blown to the sludge 31 stored in the sludge storage tank T1.

By repeating the above operation or working, the sludge 31 stored in the sludge storage tank T1 can be transferred to the transfer tank T2.

PRIOR ART DOCUMENT

Patent Document

Patent Document 1: Japanese Patent Publication No. 4356728

DISCLOSURE OF THE INVENTION

Problems to be Solved by the Invention

As described above, the conventional transfer device provides the following advantageous effects.

(1) Since a series of sludge transfer operation can be performed by remote control operation by the control device 47 in accordance with information images or like from the monitoring cameras 45 and 46, exposure amount of radiation to an operator can be reduced in minimum.

(2) The sludge 31 can be surely crushed by highly pressurized water jet of the supernatant solution 32. Further, the crushing of the sludge 31 is initially performed by blasting air to the sludge 31.

(3) Since, as the highly pressurized water used for crushing the sludge 31, the supernatant solution 32 initially stored in the sludge storage tank T1 is used, an amount of radioactive waste does not increase. Further, in a case when an external water is used, an amount of radioactive waste will be increased correspondingly.

However, against the above advantageous effects, the conventional transfer device provides the following defects or disadvantages.

(a) Since the air-nozzle 36, the supernatant solution jet nozzle 42, and the sludge transfer pump P1 are independently installed inside the sludge storage tank T1, it is difficult to move them as an integral unit. Therefore, in a case where it is required to change a portion to be crushed of the sludge in the sludge storage tank T1, it is necessary to move the above members or devices independently to predetermined portions, requiring much time for transferring the sludge.

(b) First-time crushing of the sludge 31 inside the sludge storage tank T1 is performed by blowing air from the air-blowing device 33 to the supernatant solution within the sludge storage tank T1 to thereby locally stir the supernatant solution. However, only by the blowing of the air, it is hard to crush the sludge 31, and hence, much time is required to crush the sludge 31.

(c) Although it is possible to transfer most amount of the sludge 41 stored in the sludge storage tank T1 to the transfer tank T2, a few amount of sludge 41 inevitably remains in the sludge storage tank T1 in consideration of essential performance of the sludge transfer pump P1. Furthermore, since the transferring working of the residual sludge solution has been performed by manual operation, there remains a fear of radiation exposure to the operator.

Accordingly, an object of the present invention is to provide a radioactive sludge transfer apparatus capable of suppressing radiation exposure to a worker in minimum, transferring sludge without increasing amount of radioactive waste, and moving the sludge in a supernatant solution in a sludge storage tank freely for a short time, thereby surely and effectively crushing the sludge disposed in any position in the sludge storage tank, surely sucking the crushed sludge to transfer the sludge for a short time, and furthermore, surely and effectively crushing the sludge from the initial stage of crushing the sludge in the sludge storage tank.

In such view points, the sludge can be surely transferred for a short time, and residual sludge remaining in the sludge storage tank can be surely sucked and then transferred to a transfer tank.

Means for Solving the Problem

The present invention was made to achieve the above object and is provided with the following characteristic features.

[1] A radioactive sludge transfer apparatus for transferring sludge stored in one tank with supernatant solution to another tank, including: a transfer apparatus body; a stirring apparatus for blasting the supernatant solution to the sludge to thereby produce sludge solution in the one tank; sludge solution transfer means for transferring the sludge solution to the another one tank; an attitude control float; a floating force control ballast tank; and control means for remotely controlling the stirring apparatus, the sludge solution transfer means and the floating force control ballast tank, wherein the stirring apparatus, the sludge solution transfer means, the attitude control float, and the floating force control ballast tank are mounted respectively to the transfer apparatus body; the stirring apparatus is provided with a supernatant solution suction pump for sucking the supernatant solution and an injection nozzle for jetting the supernatant solution to the sludge in the one tank to thereby form the sludge solution, the injection nozzle having freely controllable nozzle angle; the sludge solution transfer means is provided with a sludge solution suction pump for sucking the sludge solution and transfer the sucked sludge solution to the another tank; and the sludge solution suction pump has suction ports including bottom suction ports and side suction ports which are opened or closed by the open/close means, and when the sludge solution remaining inside the one tank is sucked out, the side suction ports are closed by the open/close means.

[2] In the radioactive sludge transfer apparatus recited in the above [1], the stirring apparatus acts to jet the supernatant solution sucked by the supernatant solution suction pump, together with air.

[3] A radioactive sludge transfer apparatus for transferring sludge stored in one tank with supernatant solution to another tank, including: a transfer apparatus body; stir-transfer means for blasting the supernatant solution to the sludge to thereby produce sludge solution in the one tank and transfer the sludge solution to the another tank; an attitude control float; a floating force control ballast tank; and control means for remotely controlling the stir-transfer means and the floating force control ballast tank, wherein the stir-transfer means, the attitude control float and the floating force control ballast tank are mounted respectively to the transfer apparatus body; the stir-transfer means includes: a suction pump for sucking the sludge solution; a supernatant solution suction pump for sucking the supernatant solution and an injection nozzle for jetting the supernatant solution sucked by the suction pump to the sludge to thereby form the sludge solution, the injection nozzle having freely controllable nozzle angle; and a flow path switching valve; the sludge solution suction pump has suction ports including bottom suction ports and side suction ports which are opened or closed by open/close means; and when the supernatant solution is jetted from the injection nozzle, the flow switching valve is switched on the injection nozzle side, and when the sludge remaining inside the one tank is sucked out, the side suction ports are closed by the open/close means.

[4] In the radioactive sludge transfer apparatus recited in the above [3], the stir-transfer means acts to jet the supernatant solution sucked by the supernatant solution suction pump, together with air.

[5] In the radioactive sludge transfer apparatus recited in any one of the above [1] to [4], the open/close means is composed of a cylindrical member movable along the suction ports and formed with openings each having a diameter substantially the same as that of the side suction port.

[6] In the radioactive sludge transfer apparatus recited in any one of the above [1] to [5], the injection nozzle is mounted each of four corner portions of the transfer apparatus body.

Effects of the Invention

According to the present invention, the following advantageous effects will be attained.

(1) The operation from the sludge crushing to the sludge transferring can be entirely remotely performed, radiation exposure to workers can be minimally suppressed.

(2) Since the supernatant solution is circularly used, the sludge can be transferred without increasing amount of radioactive waste.

(3) Since all the devices or like for performing the sludge crushing to transferring operations are mounted to the transfer apparatus body, the radioactive sludge transfer apparatus can be made compact in small size.

(4) Since the sludge transfer apparatus can be freely moved in the supernatant solution in the sludge storage tank for a short time, the sludge stored in any portion in the sludge storage tank can be surely and effectively crushed and the sludge solution formed by the crushing can be surely sucked, and as a result, the sludge can be transferred for a short time.

(5) Since the sludge can be crushed from an initial stage by blasting the supernatant solution, the sludge can be surely crushed for a short time, and as a result, the sludge can be transferred for a short time.

(6) When the remaining sludge solution is sucked, the remaining sludge is sucked out through the bottom suction ports by closing the side suction ports of the suction pump, so that the sludge solution remaining in the sludge storage tank can be surely sucked and then transferred to the transfer tank.

BRIEF DESCRIPTION OF THE DRAWINGS

FIG. 7(2) includes front views showing states of crushing and stirring the sludge by the radioactive sludge transfer apparatus according to the present invention, in which (e) is a view showing a state of crushing and stirring the sludge by means of one of injection nozzles in a horizontal attitude of the apparatus while being submerged, (f) is a view showing a state of crushing and stirring the sludge disposed near a wall portion while being submerged in the horizontal attitude, (g) is a view showing a state of crushing and stirring the sludge while being submerged in the supernatant solution in the horizontal attitude, and (h) is a view showing a state of crushing and stirring the wall side sludge while being submerged in an inclined attitude.

MODE FOR EMBODYING THE INVENTION

One embodiment of a radioactive sludge transfer apparatus according to the present invention will be explained hereunder with reference to the accompanying drawings.

Figure 1:
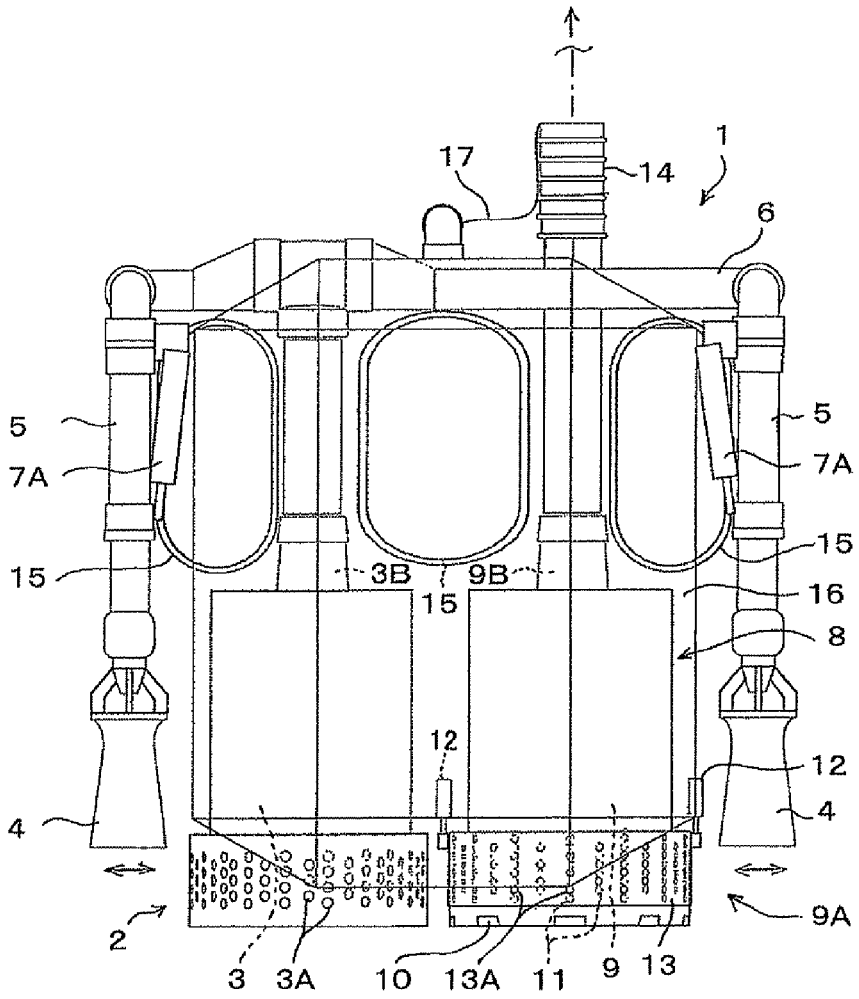
FIG. 1 is a front view illustrating a radioactive sludge transfer apparatus according to the present invention.
Figure 2:
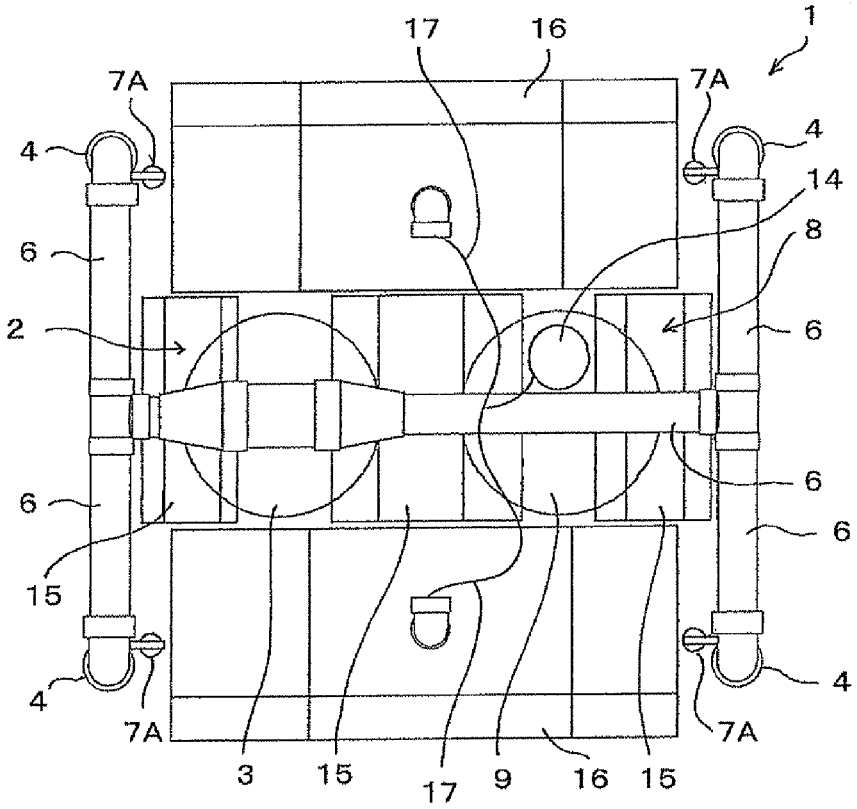
FIG. 2 is a plan view illustrating a radioactive sludge transfer apparatus according to the present invention.
Figure 3:
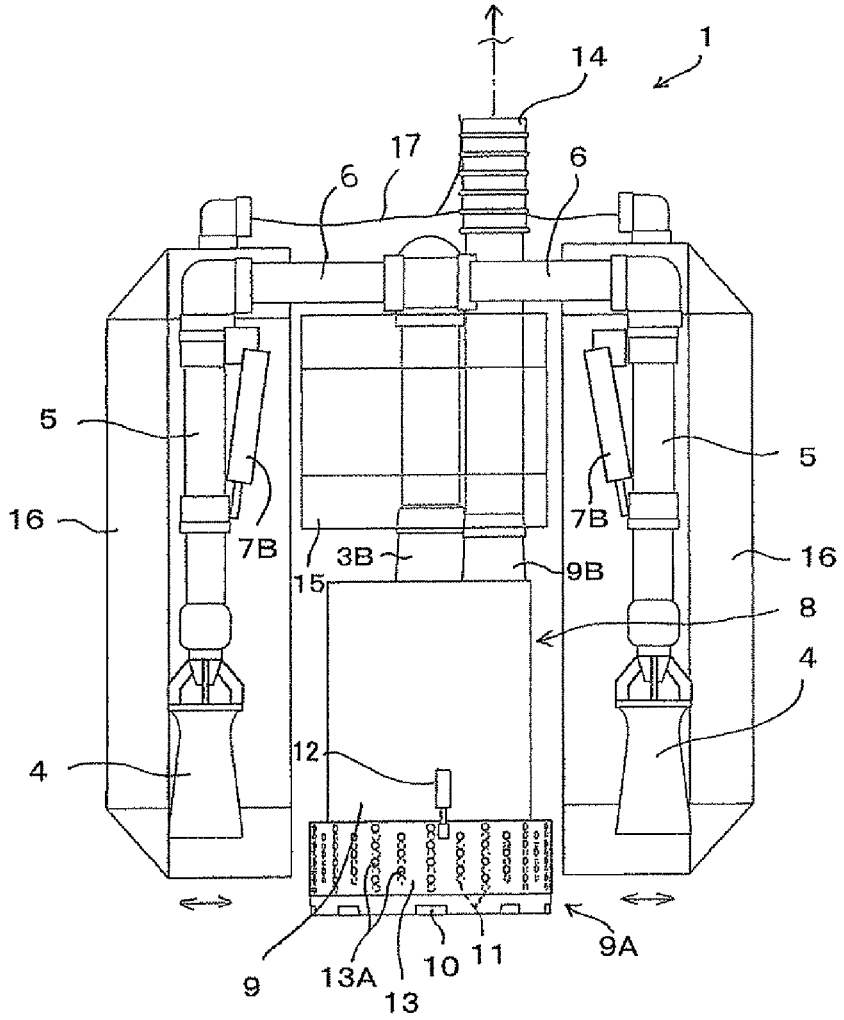
FIG. 3 is a right side view illustrating a radioactive sludge transfer apparatus according to the present invention.

FIG. 1 is a front view illustrating a radioactive sludge transfer apparatus according to the present invention, FIG. 2 is a plan view illustrating a radioactive sludge transfer apparatus according to the present invention, and FIG. 3 is a right side view illustrating a radioactive sludge transfer apparatus according to the present invention. It is further to be noted that the sludge storage tank T1, the transfer tank T2, the sludge 31, the supernatant solution 32, and the sludge solution 37 are substantially the same as those shown in the illustration of the structure of the conventional transferring apparatus shown in FIG. 11.

With reference to FIGS. 1 and 2, reference numeral 1 is a transfer apparatus body, and a sludge solution flow path or channel 6 through which the sludge solution inside the sludge storage tank T1 as one of tanks is formed in the transfer apparatus body 1.

Reference numeral 2 denotes a stifling apparatus mounted to the transfer apparatus body 1 and acting to blow the supernatant 32 in the transfer tank T2 as another one of tanks against the sludge 31 stored inside the sludge storage tank T1 to thereby form the sludge solution 37 in the sludge storage tank T1.

The stirring apparatus 2 is provided with a supernatant solution suction pump 3 having a suction port 3A for the supernatant solution 32 in the transfer tank T2, and an injection nozzle 4 for jetting the supernatant solution 32 against the sludge 31 in the sludge storage tank T1, thereby crushing and stirring the sludge so as to form the sludge solution 37.

The injection nozzle 4 is composed of an ejector nozzle which is mounted to each corner of four corner portions of the transfer apparatus body 1 so as to be directed downward. The sludge 31 may be more effectively crushed by injecting the supernatant solution 32 together with air through the injection nozzle 4.

The injection nozzle 4 is attached to a front end portion of a hose 5 having flexibility, and the hose 5 is connected to an exhaust port 3B of the suction pump 3 of the stirring apparatus via the sludge flow path 6 formed in the transfer apparatus body 1. Further, cylinders 7A and 7B are provided between the injection nozzle 4 and an upper end portion of each of the hoses 5. The cylinder 7A functions to move the radioactive sludge transfer apparatus in the lateral direction (right and left direction in FIG. 1) by inclining the injection nozzle 4 in the lateral direction as shown with arrow in FIG. 1 through the hose 5. On the other hand, the cylinder 7B functions to move the radioactive sludge transfer apparatus in the lateral direction (right and left direction in FIG. 3) by inclining the injection nozzle 4 in the lateral direction as shown with arrow in FIG. 3 through the hose 5.

Figure 11:
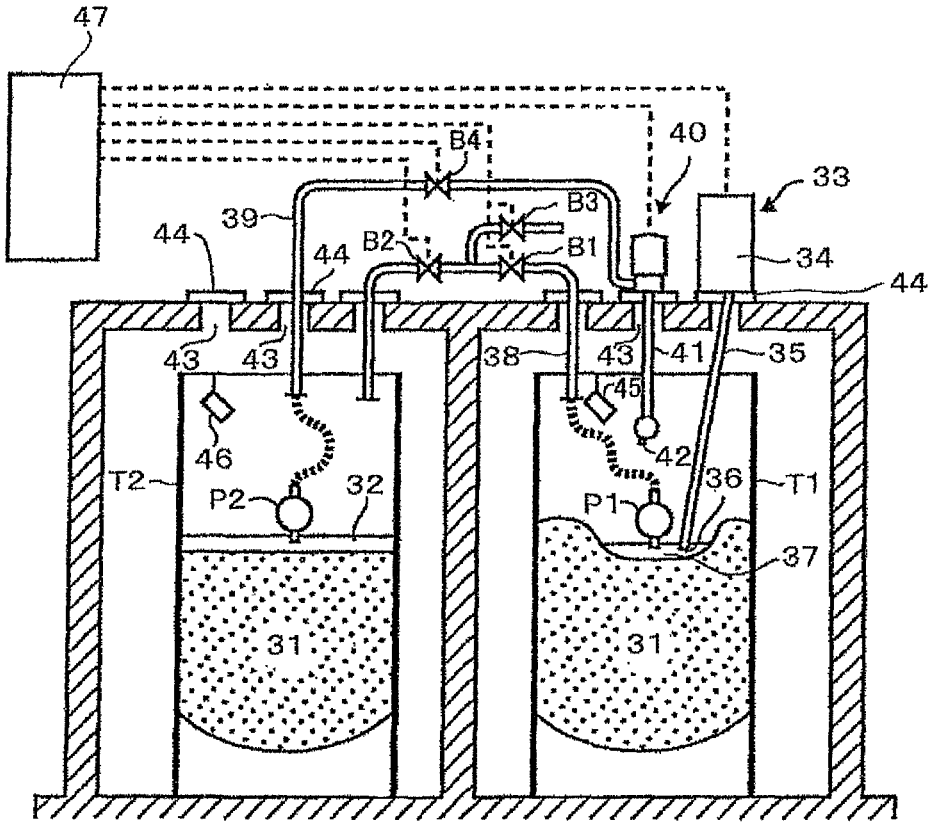
FIG.11 Prior Art
FIG. 11 is a view illustrating a structure of a conventional transfer apparatus.

Accordingly, by adjusting the inclining angles of the cylinders 7A and 7B, the radioactive sludge transfer apparatus is freely moved in the supernatant solution 32 of the sludge storage tank T1 (FIG. 11 does not show the supernatant solution 32 in the sludge storage tank T1). The transferring mode of the radioactive sludge transfer apparatus will be described hereinafter. The suction pump 3 and the cylinders 7A, 7B for the stirring apparatus are remotely controllable by control means disposed externally of the sludge storage tank T1.

Reference numeral 8 denotes a sludge solution transfer means mounted to the transfer apparatus body for transferring the sludge solution 37 in the sludge storage tank T1 to the transfer tank T2. The sludge solution transfer means 8 is provided with a sludge solution suction pump 9 for sucking the sludge solution 37 in the sludge storage tank T1 and then transferring the sludge solution 37 to the transfer tank T2.

Figure 4:
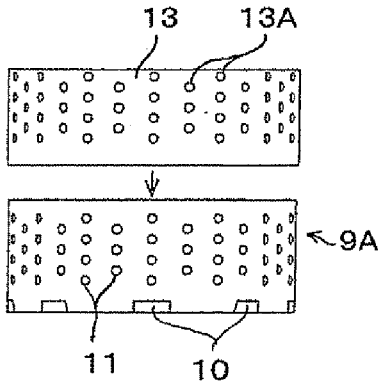
FIG. 4 is a developed front view illustrating a suction port of a suction pump of the radioactive sludge transfer apparatus according to the present invention.
Figure 5:
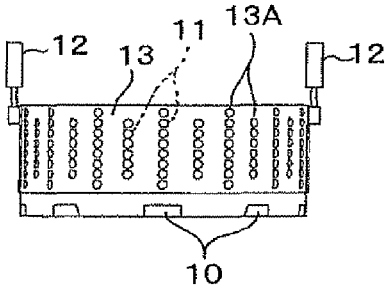
FIG. 5 is a front view showing a state in which a side suction port is opened.
Figure 6:
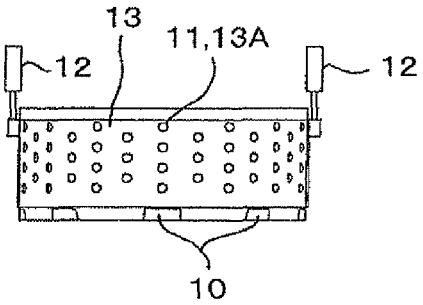
FIG. 6 is a front view showing a state in which a side suction port is closed.

As shown in FIG. 4, the sludge solution suction pump 9 has a suction port 9A which includes bottom suction ports 10 and side suction ports 11. As shown in FIGS. 5 and 6, the side suction ports 11 are capable of being opened or closed by cylindrical open/close means 13 attached to the outer side of the side suction ports 11 to be vertically movable by a cylinder 12. The open/close means 13 is formed with openings 13A each having a diameter equal to that of the side suction port 11 at a portion corresponding to each of the suction ports 11.

As shown in FIG. 5, the side suction ports 11 are closed by vertically moving the open/close means 13 according to the operation of the cylinder 12 to thereby displace the positions of the side suction ports 11 of the sludge solution suction pump 9 from the positions of the openings 13A of the open/close means 13, and only the bottom suction ports 10 is released, so that it becomes possible to effectively suck the residual sludge solution 37. Then, by vertically moving the open/close means 13 by the cylinder 12 so as to accord the positions of the side suction ports 11 of the sludge solution suction pump 9 with the positions of the openings 13A of the open/close means 13, it becomes possible to suck the sludge solution 37 through the bottom suction ports 10 and the side suction ports 11. Further, it may be possible to open the side suction ports 11 of the sludge solution suction pump 9 by rotating the open/close means 13.

The discharge port 9B of the sludge solution suction pump 9 is connected to the sludge solution transfer pipe 14, and the sludge solution 37 is transferred into the transfer tank T2 through the sludge solution transfer pipe 14. Further, the sludge solution suction pump 9 and the cylinder 11 are configured to be remotely controllable by the control means from the external side of the sludge storage tank T1.

Reference numeral 15 denotes an attitude (position) control float mounted to an upper portion inside the transfer apparatus body 1. The attitude control float 15 has a function to prevent the radioactive sludge transfer apparatus from being inverted in the supernatant solution 32 inside the sludge storage tank T1.

Reference numeral 16 denotes a floating force control ballast tank which is mounted to the transfer apparatus body 1 on each of both sides of the attitude control float 15. The floating force control ballast tank 16 has a bottom portion which is opened, and air is injected into the floating force control ballast tank 16 through an air pipe 17. By controlling the air injection amount into the floating force control ballast tank 16, it becomes possible for the radioactive sludge transfer apparatus to freely float upward or submerge in the supernatant solution 32 in the sludge storage tank T1. Accordingly, the sludge 31 existing in the sludge storage tank T1, even in any portion, can be surely and effectively crushed, and the thus crushed sludge solution 37 can be surely sucked. As a result, the sludge 31 can be transferred for a short time into the transfer tank T2. The air injection amount into the floating force controlling ballast tank 16 can be remotely controlled y the control means mentioned hereinbefore.

As described above, since the stirring apparatus 2 and the sludge solution transfer means 8 are mounted to the transfer apparatus body, the radioactive sludge transfer apparatus can be made compact.

According to the radioactive sludge transfer apparatus according to the present invention of the structures mentioned above, the sludge 1 stored in the sludge storage tank T1 is transferred into the transfer tank T2.

Figure 7:
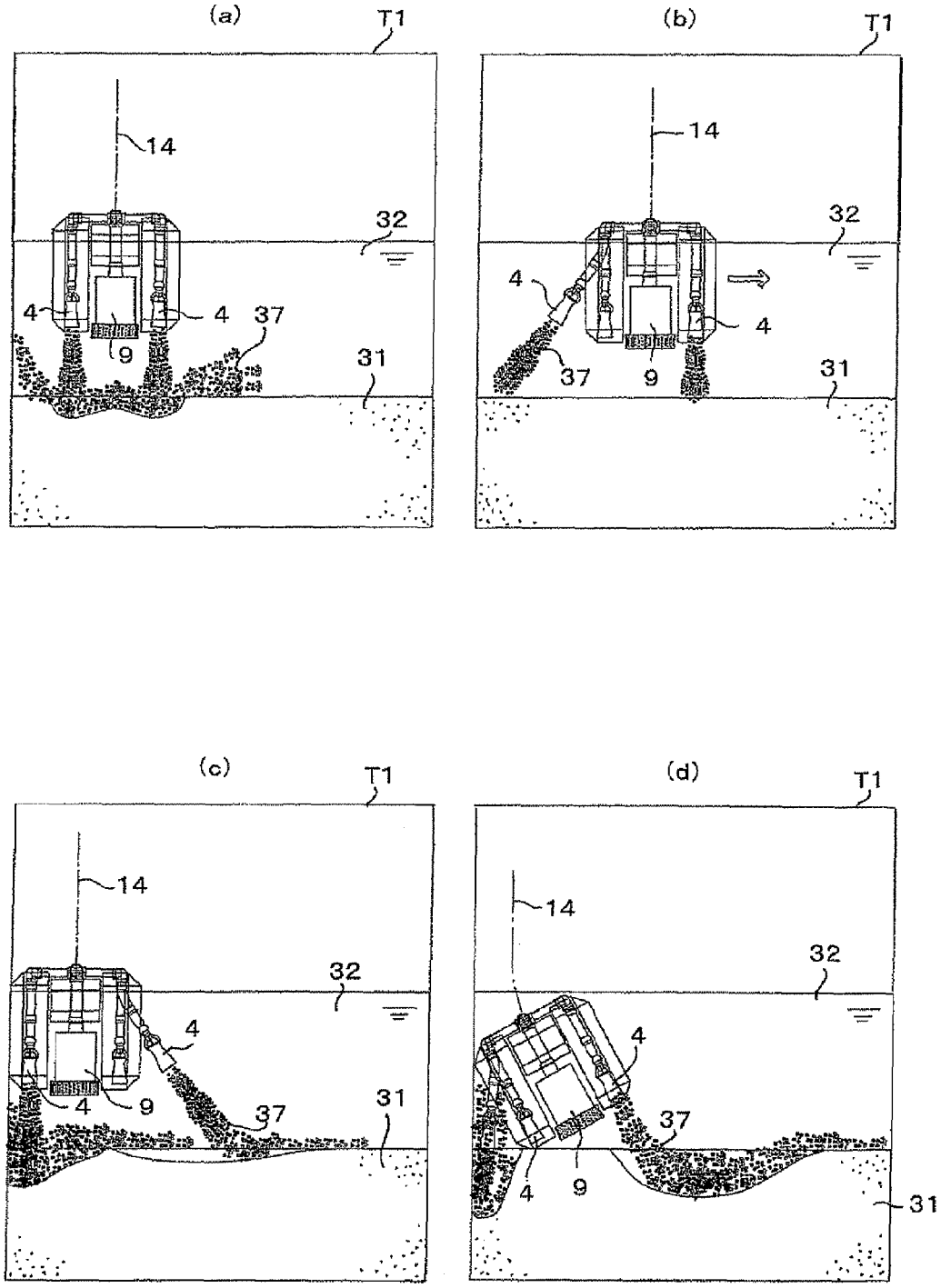
FIG. 7(1) includes front views showing states of crushing and stirring the sludge by the radioactive sludge transfer apparatus according to the present invention, in which (a) is a view showing a state of crushing and stirring the sludge from surface of a supernatant solution, (b) is a view showing a state of moving the apparatus on the surface of the supernatant solution, (c) is a view showing a state of crushing and stirring the sludge disposed near a wall portion, and (d) is a view showing a state of crushing and stirring the wall side sludge while the apparatus is submerging in the supernatant solution in an inclined attitude.
Figure 7:
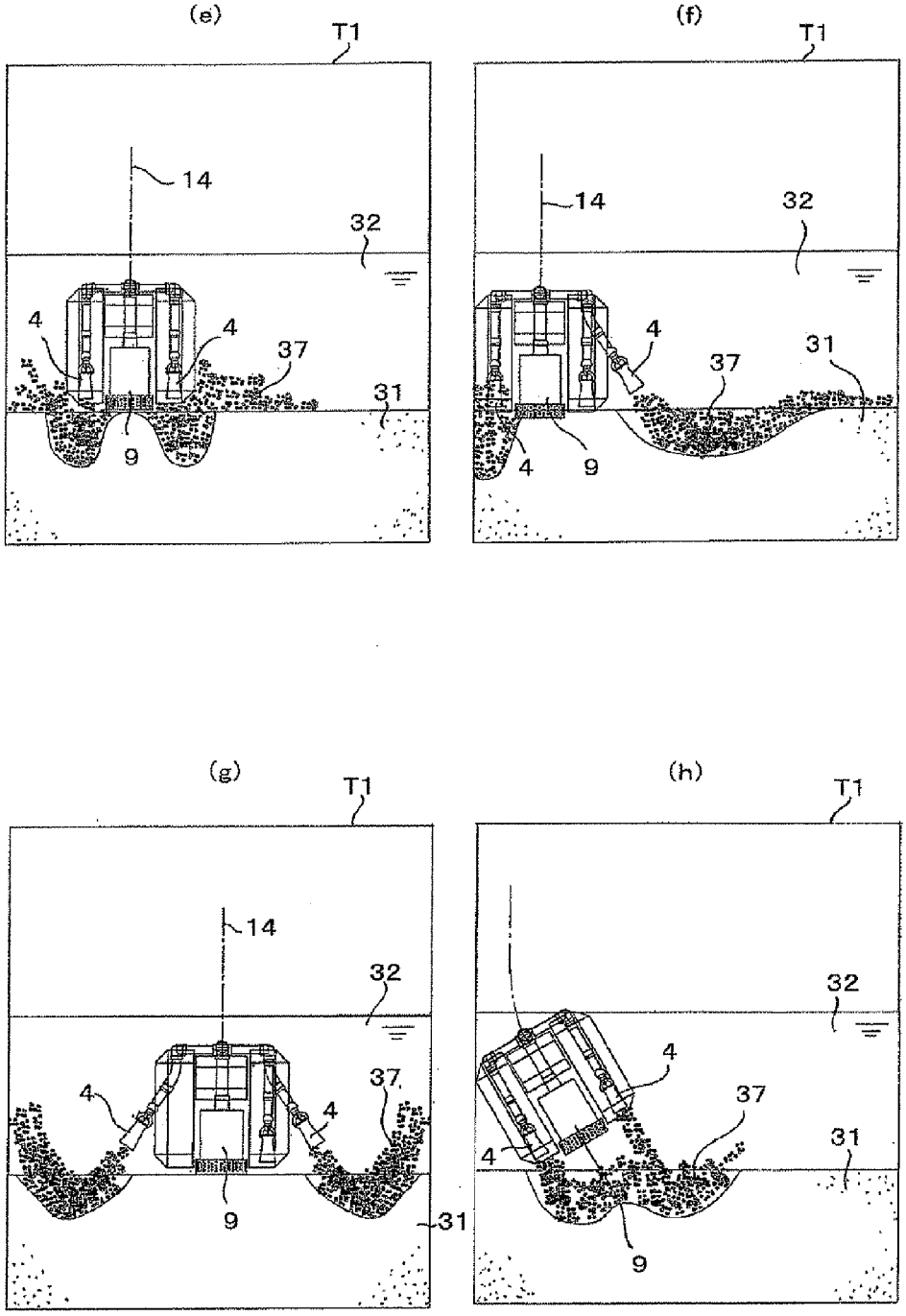

As shown in FIG. 7(*a*), the radioactive sludge transfer apparatus is floated on the supernatant solution 32 in the sludge storage tank T1 by controlling the ballast of the floating force control ballast tank 16, and under the state, the supernatant solution 32 in the sludge solution storage tank T1 sucked by the supernatant solution suction pump 3 is blasted toward the sludge 31 into the sludge storage tank T1 by the injection nozzle 4, whereby the sludge 31 is crushed and stirred, thus forming the sludge solution 37. The thus formed sludge solution 37 is sucked by the sludge solution suction pump 9, and then, transferred into the transfer tank T2 via the sludge solution transfer pipe 14. At this time, the open/close means 13 is moved, by the cylinder 12, to the position at which the side suction ports 11 of the sludge solution suction pump 9 accords with the openings 13A of the open/close means 13 to thereby suck the sludge solution 37 from both the bottom suction ports 10 and the side suction ports 11 as shown in FIG. 6.

Further, the sludge solution 37 transferred into the transfer tank T2 is separated into the sludge 31 and the supernatant solution 32 as time passes. Thereafter, the supernatant solution 32 in the transfer tank T2 is transferred into the sludge storage tank T1, and is again blasted toward the sludge 31 stored in the sludge storage tank T1 by the manner mentioned hereinbefore.

By the manner mentioned above, according to the radioactive sludge transfer apparatus of the present invention, the sludge 1 stored in the sludge storage tank T1 can be transferred to the transfer tank T2 with minimal exposure of radiation to a worker without increasing an amount of radioactive waste.

In order to suck the residual sludge solution 37 in the sludge storage tank T1 and then transfer the same to the transfer tank T2, the open/close means 13 is vertically moved by the cylinder 12 so as to displace the position of the openings 13A of the open/close means 13 from the side suction ports 11 of the sludge solution suction pump 9, thereby closing the side suction posts 11 and opening only the bottom suction ports 10. Thus, the residual sludge solution 37 within the sludge storage tank T1 can be surely sucked and transferred in the transfer tank T2.

Next, FIG. 7(*b*) illustrates a state for horizontally moving the radioactive sludge transfer apparatus in a state in which the radioactive sludge transfer apparatus is floating on the surface level of the supernatant solution 32 in the sludge storage tank T1, and in order to achieve such horizontal moving, the supernatant solution 32 is jetted from both the injection nozzles 4 in a state in which one of the injection nozzles 4 is inclined outward and the other one of the injection nozzles 4 is directed downward. In the above disclosure, "one" of the injection nozzles 4 means the left side nozzle 4 in FIG. 7(*b*) and "the other one" of the injection nozzles 4 means the right side nozzle in FIG. 7(*b*) (as the case may be). According to such operation, the radioactive sludge transfer apparatus is moved from the left side to the right side in the state shown in FIG. 7(*b*).

FIG. 7(*c*) illustrates a state for crushing and stirring the sludge 31 stored in position near the wall side in the sludge storage tank T1 in a state in which the radioactive sludge transfer apparatus is floating on the surface level of the supernatant solution 32 in the sludge storage tank T1, and in order to achieve such crushing and stirring, the supernatant solution 32 is jetted from both the injection nozzles 4 in a state in which one of the injection nozzles 4 is directed downward and the other one of the injection nozzles 4 is inclined outward. According to such operation, the sludge 31 near the wall side can be crushed and stirred in the state in which the radioactive sludge transfer apparatus is floating on the surface level of the supernatant solution 32.

FIG. 7(*d*) illustrates a state for crushing and stirring the sludge 31 stored in position near the wall side in the sludge storage tank T1 in a state in which the radioactive sludge transfer apparatus is submerged in an inclining attitude in the supernatant solution 32 in the sludge storage tank T1, and in order to achieve such crushing and stirring, the radioactive sludge transfer apparatus is submerged under the control of the ballast in the floating force control ballast tank 16, and then the supernatant solution 32 is jetted from the other one of the injection nozzles 4. According to such operation, the sludge 31 near the wall side can be crushed and stirred in the state in which the radioactive sludge transfer apparatus is floating on the surface level of the supernatant solution 32.

FIG. 7(*e*) illustrates a state for crushing and stirring the sludge 31 in the sludge storage tank T1 in a state in which the radioactive sludge transfer apparatus is submerged in a perpendicular attitude in the supernatant solution 32 in the sludge storage tank T1, and in order to achieve such crushing and stirring, the supernatant solution 32 is jetted from the both the injection nozzles 4 in a state in which one and the other one of the injection nozzles 4 are both directed downward. According to such operation, the sludge 31 can be crushed and stirred in the state in which the radioactive sludge transfer apparatus is submerged in the supernatant solution 32 at the perpendicular attitude.

FIG. 7(*f*) illustrates a state for crushing the sludge 31 stored in position near the wall side in the sludge storage tank T1 in a state in which the radioactive sludge transfer apparatus is submerged in a perpendicular attitude in the supernatant solution 32 in the sludge storage tank T1, and in order to achieve such crushing, the supernatant solution 32 is jetted from the both the injection nozzles 4 in a state in which one of the injection nozzles 4 is directed downward and the other one of the injection nozzles 4 is inclined outward. According to such operation, the sludge 31 disposed near the wall side and the sludge 31 disposed apart from the wall side can be crushed and stirred in the state in which the radioactive sludge transfer apparatus is submerged in the supernatant solution 32 at the perpendicular attitude.

FIG. 7(*g*) illustrates a state for crushing and stirring the sludge 31 stored in the sludge storage tank T1 in a state in which the radioactive sludge transfer apparatus is submerged in a perpendicular attitude in the supernatant solution 32 in the sludge storage tank T1, and in order to achieve such crushing and stirring, the supernatant solution 32 is jetted from the both the injection nozzles 4 in a state in which one and the other one of the injection nozzles 4 are both inclined outward. According to such operation, the sludge 31 can be crushed and stirred in a wide range.

FIG. 7(*h*) illustrates a state for crushing and stirring the sludge 31 stored in position near the wall side in the sludge storage tank T1 in a state in which the radioactive sludge transfer apparatus is submerged in an inclined attitude in the supernatant solution 32 in the sludge storage tank T1, and in order to achieve such crushing and stirring, the supernatant solution 32 is jetted from the both the injection nozzles 4 in a state in which the one and the other one of the injection nozzles 4 are both inclined outward. According to such operation, the sludge 31 can be crushed and stirred in a wide range with the radioactive sludge transfer apparatus being inclined toward the wall side of the sludge storage tank T1.

Hereunder, a radioactive sludge transfer apparatus according to another embodiment of the present invention will be explained with reference to the accompanying drawings.

Figure 8:
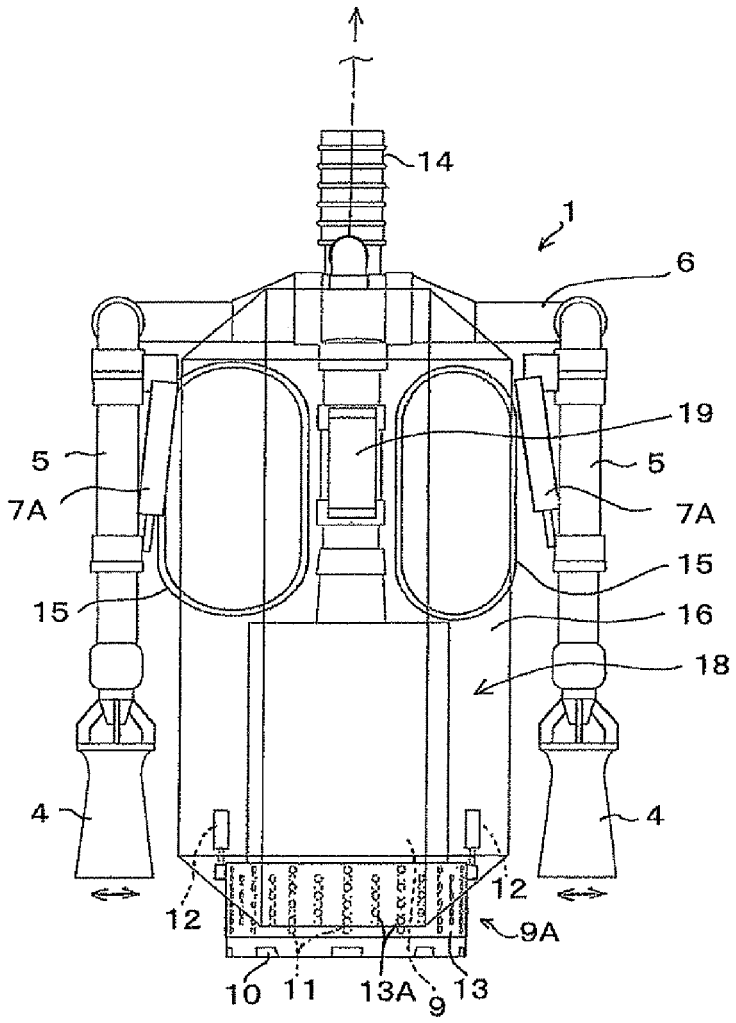
FIG. 8 is a front view illustrating another radioactive sludge transfer apparatus according to the present invention.
Figure 9:
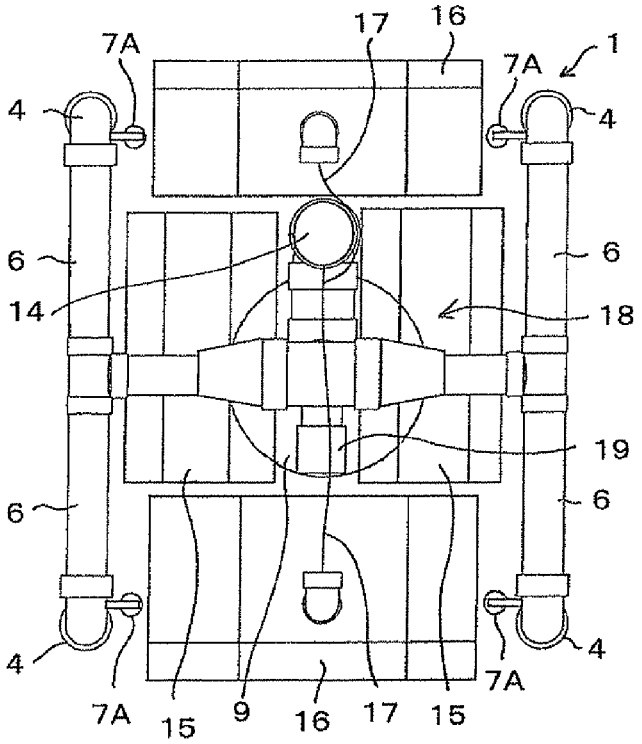
FIG. 9 is a plan view illustrating the other radioactive sludge transfer apparatus according to the present invention.
Figure 10:
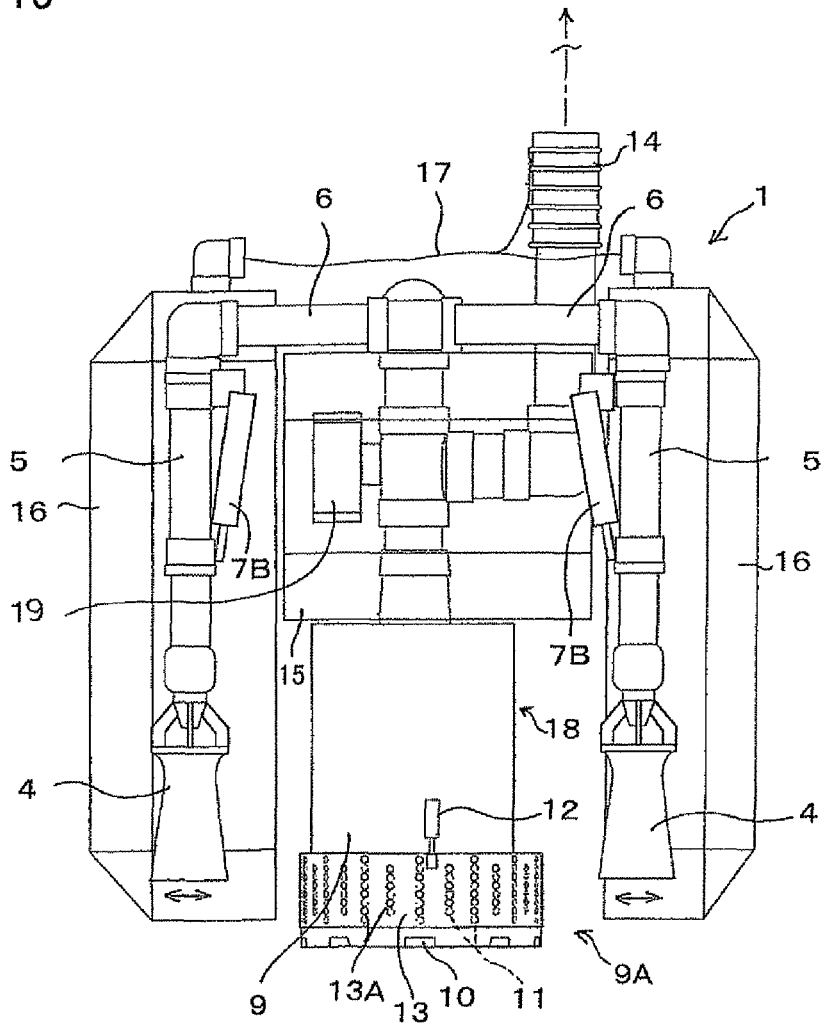
FIG. 10 is a right side view illustrating the other radioactive sludge transfer apparatus according to the present invention.

FIG. 8 is a front view illustrating another radioactive sludge transfer apparatus according to the present invention, FIG. 9 is a plan view illustrating the another radioactive sludge transfer apparatus according to the present invention, and FIG. 10 is a right side view illustrating the another radioactive sludge transfer apparatus according to the present invention.

The radioactive sludge transfer apparatus of the another embodiment of the present invention performs the crushing and stirring of the sludge 31 in the sludge storage tank T1 and transfers the sludge solution 37 in the sludge storage tank T1 by means of one suction pump, in the radioactive sludge transfer apparatus shown in FIGS. 1 to 3, and hence, the same reference numerals are added to the members or like corresponding to those shown in FIGS. 1 to 3.

That is, the radioactive sludge transfer apparatus according to this another embodiment is not provided with the stirring apparatus 2 provided for the radioactive sludge transfer apparatus of the first embodiment of the present invention shown in FIGS. 1 to 3, and the sludge solution transfer means 8 is newly provided as stir-transfer means 18, and a flow path switching valve 19 is also newly provided.

The stir-transfer means 18 has function of sucking the supernatant solution 32, and injecting the supernatant solution 32 toward the sludge 31 through the injection nozzle 4 to thereby crush and stir the sludge 31 and also has function of sucking the sludge solution 37 and transferring the sucked sludge solution to the transfer tank T2.

The flow path switching valve 19 acts to switch the flow path at the time of injecting the supernatant solution 32 from the injection nozzle 4 to the injection nozzle d side, and on the other, to switch the flow path at the time of transferring the sludge solution 37 into the transfer tank T2 to the sludge solution transfer pipe 14 side.

Further, in the radioactive sludge transfer apparatus according to this another embodiment, the sludge solution sucking pump 9 sucks both the supernatant solution 32 and the sludge solution 37, and accordingly, this sludge solution sucking pump 9 is called merely suction pump hereunder.

According to the radioactive sludge transfer apparatus of this another embodiment of the structure mentioned above, the sludge 31 stored in the sludge storage tank T1 is transferred into the transfer tank T2 in the following manner.

As shown in FIG. 7, by controlling the ballast in the floating force control ballast tank 16, the radioactive sludge transfer apparatus is floated on the surface level of the supernatant solution 32 in the sludge storage tank T1, and under this state, the flow path is switched on the injection nozzle 4 side by the flow path switching valve 19. Then, the supernatant solution inside the sludge storage tank T1 sucked by the suction pump 9 is blasted toward the sludge 31 in the sludge storage tank T1 from the injection nozzle 4, thereby crushing and then stirring the sludge 31, thus forming the sludge solution 37.

After the sludge solution 37 has been formed in the sludge storage tank T1 by the manner mentioned above, the flow path is switched on the sludge solution transfer pipe 14 side by the flow path switching valve 19. Thereafter, the sludge solution 37 is sucked by the suction pump 9 and transferred to the transfer tank T2 through the sludge solution transfer pipe 14. In this operation, the open/close means 13 is moved by the operation of the cylinder 12 to the position at which the side suction ports 11 of the sludge solution suction pump 9 accord with the openings 13A of the open/close means 13, and as shown in FIG. 6, the sludge solution 37 can be sucked through both the bottom side suction ports 10 and the side suction ports 11.

As mentioned above, according to the radioactive sludge transfer apparatus of the another embodiment of the present invention, the radioactive sludge stored in the sludge storage tank T1 can be transferred to the transfer tank T2 with minimally reduced radiation exposure to workers, and moreover, without increasing amount of radioactive waste by circularly using the supernatant solution.

In order to suck the sludge solution 37 remaining in the sludge storage tank T1 and then transfer the same to the transfer tank T2, the open/close means 13 is vertically moved by means of the cylinder 12 to shift the location of the openings 13A of the open/close means 13 from the location of the side suction ports 11 to thereby close the side suction ports 11 and release (i.e., open) only the bottom suction ports 10. According to such operation, the sludge solution 37 remaining in the sludge storage tank T1 can be surely sucked out and transferred to the transfer tank T2.

According to this another radioactive sludge transfer apparatus of the present invention, as also shown in FIG. 7(*b*) to (*h*), the sludge can be crushed and stirred.

REFERENCE NUMERALS

T1—sludge storage tank
T2—transfer tank
1—transfer apparatus body
2—stirring apparatus
3—supernatant solution suction pump
3A—suction port
3B—exhaust port
4—injection nozzle
5—hose
6—sludge solution flow path
7A—cylinder
7B—cylinder
8—sludge solution transfer means
9—sludge solution suction pump
10—bottom suction port
11—side suction port
12—cylinder
13—open/close means
14—sludge solution transfer pipe
15—attitude control float
16—floating force control ballast tank
17—air duct
18—stir/transfer means
19—flow path switching valve
31—sludge
32—supernatant solution
33—air-blowing device
34—air supply source
35—air pipe
36—air nozzle
37—sludge solution
38—sludge solution supply path
39—supernatant solution transfer path
40—supernatant solution jetting device
41—supernatant solution pipe
42—supernatant solution jetting nozzle
43—inspection port
44—radiation shielding means
45—monitor camera
46—monitor camera
47—control device

The invention claimed is:

1. A radioactive sludge transfer apparatus for transferring sludge stored in a first tank with supernatant solution to a second tank, comprising:

a transfer body;

a stirrer configured to blast the supernatant solution to the sludge to thereby produce sludge solution in the first tank;

a sludge solution transferer configured to transfer the sludge solution to the second tank;

an attitude control float;

a floating force control ballast tank; and a controller configured to remotely control the stirrer, the sludge solution transferer and the floating force control ballast tank, wherein the stirrer, the sludge solution transferer, the attitude control float, and the floating force control ballast tank are mounted respectively to the transfer body, the stirrer is provided with a supernatant solution suction pump configured to suck the supernatant solution and an injection nozzle configured to jet the supernatant solution to the sludge in the first tank to thereby form the sludge solution, the injection nozzle having freely controllable nozzle angle, the sludge solution transferer is provided with a sludge solution suction pump configured to suck the sludge solution and transfer the sucked sludge solution to the second tank, and the sludge solution suction pump has suction ports including bottom suction ports and side suction ports which are opened or closed by an open/close device, and when the sludge solution remaining inside the first tank is sucked out, the side suction ports are closed by open/close device.

2. The radioactive sludge transfer apparatus according to claim 1, wherein the stirrer is configured to jet the supernatant solution sucked by the supernatant solution suction pump, together with air.

3. The radioactive sludge transfer apparatus according to claim 1, wherein the open/close device comprises:

a cylindrical member movable along the side suction ports and openings each having a diameter substantially same as that of the side suction ports.

4. The radioactive sludge transfer apparatus according to claim 1, wherein the injection nozzle is mounted to each of four corner portions of the transfer body.

* * * * *